US005744199A

United States Patent [19]

Joffre et al.

[11] Patent Number: 5,744,199

[45] Date of Patent: Apr. 28, 1998

[54] METHOD OF SEALING OPENINGS IN STRUCTURAL COMPONENTS OF BUILDINGS FOR CONTROLLING THE PASSAGE OF SMOKE

[75] Inventors: Eric Jude Joffre; Robert Mark Schroeder; Arthur James Tselepis; Andreas Thomas Franz Wolf, all of Midland, Mich.

[73] Assignee: Dow Corning Corporation, Midland, Mich.

[21] Appl. No.: 740,576

[22] Filed: Oct. 31, 1996

[51] Int. Cl.[6] ..... B05D 1/02; B05D 3/00

[52] U.S. Cl. ..... 427/389; 427/388.4; 427/393.3; 427/393.6; 427/421

[58] Field of Search ..... 427/407.3, 387, 427/393.3, 389.8, 403, 393.6, 421; 52/232

[56] References Cited

U.S. PATENT DOCUMENTS

| | | | |
|---|---|---|---|
| 4,026,839 | 5/1977 | Dieck et al. | 260/2.5 |
| 4,244,849 | 1/1981 | Saam | 106/2 |
| 4,278,468 | 7/1981 | Selbe et al. | 427/403 |
| 4,387,176 | 6/1983 | Frye | 106/18.12 |
| 4,419,535 | 12/1983 | O'Hara | 52/232 |
| 4,420,511 | 12/1983 | Liedberg | 427/346 |
| 4,460,739 | 7/1984 | Ashby | 427/387 |
| 4,548,853 | 10/1985 | Bryan | 428/131 |
| 4,566,242 | 1/1986 | Dunsworth | 52/396.01 |
| 4,607,066 | 8/1986 | Barry et al. | 523/130 |
| 4,645,782 | 2/1987 | Redfarn | 523/179 |
| 4,695,507 | 9/1987 | Schwartz | 427/389.8 |
| 4,824,709 | 4/1989 | Tschirch | 428/95 |
| 5,010,148 | 4/1991 | Lewis | 525/464 |
| 5,047,449 | 9/1991 | Pastureau | 523/179 |
| 5,120,581 | 6/1992 | Brunker et al. | 427/387 |
| 5,359,735 | 11/1994 | Stockwell | 427/121 |
| 5,512,615 | 4/1996 | Olsen | 106/38.2 |

FOREIGN PATENT DOCUMENTS 0457616 11/1991 European Pat. Off. .

OTHER PUBLICATIONS

Shen, Kelvin K., "The Use of Zinc Borate as a Fire Retardant in Halogen-Free Polymer Systems", Proc. Int. Conf. Fire Saf., 12, 340–65. (No Date).

*Primary Examiner*—Diana Dudash
*Attorney, Agent, or Firm*—Patricia M. Scaduto

[57] ABSTRACT

This invention relates to a method of sealing openings in structural components of a building to reduce the amount of smoke which may pass through the opening in the event of a fire. The method comprises filling an opening in a structural component of a building with a support material; applying a coating of a silicone composition over the filled opening and allowing the silicone composition to cure into a continuous elastomeric film having certain properties. These silicone compositions exhibit pseudo plastic rheology which facilitates their application by spraying.

25 Claims, No Drawings

METHOD OF SEALING OPENINGS IN STRUCTURAL COMPONENTS OF BUILDINGS FOR CONTROLLING THE PASSAGE OF SMOKE

FIELD OF THE INVENTION

This invention relates to a method of sealing openings in structural components of a building to reduce the amount of smoke which may pass through the openings in the event of a fire.

BACKGROUND INFORMATION

One of the many problems which one encounters with constructing a building is how to seal the many openings that occur through normal construction. These openings may occur where two or more structural components of the building meet such as wall-floor joints, wall-wall joints, wall-ceiling joints etc., as well as openings in structural components which are made to accommodate objects such as cables, cable trays, conduits, mechanical piping, ducts and the like which necessarily must pass through the ceilings, walls etc.

Silicone elastomers have many properties which are desirable for sealing these types of openings, however, current techniques for achieving a smoke barrier typically utilize sealants or closed-cell foams which are pumped, gunned or trowelled into the joints. This is a laborious process and in certain cases the joints may be inaccessible to common sealing or application techniques.

An objective of this invention is to describe an improved method of sealing openings in structural components of a building to reduce the amount of smoke which may pass through the openings by applying a coating of a silicone composition which cures into a continuous elastomeric film having certain properties.

Another objective of this invention is to describe a method of sealing openings in structural components which utilizes silicone compositions which are sprayable and cure into continuous elastomeric films having certain properties.

SUMMARY OF THE INVENTION

This invention relates to a method of sealing openings in structural components of a building to reduce the amount of smoke which may pass through the opening in the event of a fire. The method comprises filling an opening in a structural component of a building with a support material; applying a coating of a silicone composition over the filled opening and allowing the silicone composition to cure into a continuous elastomeric film having certain properties.

DETAILED DESCRIPTION OF THE INVENTION

A method of sealing openings in structural components of a building to reduce the amount of smoke which may pass through the openings, which method comprises:

(a) substantially filling an opening in a structural component with a support material so that a filled opening is formed;

(b) applying a coating of a silicone composition, having a viscosity from 1000 mPa s to 120,000 mPa s measured at 24° C. and 2.5 rpm, over the filled opening, the structural component adjacent to the filled opening and any objects passing therethrough; and (c) allowing the silicone composition to cure into a continuous elastomeric film, having a minimum thickness of 0.25 mm, which adheres to the support material in the filled opening, the adjacent structural component and any objects passing therethrough and has a movement capability of at least ±3%, the film sealing the filled opening and reducing the amount of smoke which may pass through the filled opening.

As used herein, the term "structural component" refers to the various elements of a building, including for example, floors, walls and ceilings inside the building as well as the facade and other elements outside the building. As buildings are constructed, there are numerous places where openings are formed between structural components. The term "openings" as used herein refers to (a) openings which occur where at least two structural components meet, for example, joints between curtain walls and the concrete slab floors, wall to wall joints and wall to ceiling joints; (b) openings formed in at least one structural component so objects such as cables, cable trays, conduits mechanical piping, ducts and the like may be passed through; and (c) openings in a structural component itself, such as microcracks. The term "openings" as used herein does not include openings which allow ingress and egress through the building, such as doorways, stairways, etc.

The first step of this method is to substantially fill the opening with a support material so that a filled opening results. The amount of support material to be used will depend on the size of the opening and must be determined on an individual basis. Generally, however, a sufficient amount should be added so that the gap between the adjacent structural components and the support material is no greater than 3 mm in width. If there is an object passing through the opening, the gap between the support material and the object passing through the opening should also be no more than 3 mm in width. It is not required that the support material be flush with either the structural component or any object passing through the opening. If the opening prior to filling is no more than 3 mm in width, this step of filling the opening is optional because the coating is capable of bridging an opening up to 3 mm. The term "bridge" or "bridging" as used herein means capable of forming a continuous film, without cracks or voids.

Various types of materials may be used as the support materials, the main purpose for the support material being to decrease the size of the opening so that the silicone coating to be applied can bridge the opening. A secondary purpose of the support material is to provide insulation, etc. Examples of suitable support materials include but are not limited to mineral wool, fiberglass, ceramic fiber, backer board and backer rod. It is preferred that the support materials used do not limit the movement of the structural components and any objects passing through the openings. For applications which require fire ratings of the openings, it is also preferred that the support material be a non-liquid, non-combustible material. The most preferred types of support materials are mineral wool and ceramic fiber.

Next, a coating of a silicone composition is applied over the filled opening, each structural component adjacent to the filled opening and any objects passing therethrough. The longitudinal extent or overlap of the coating along the structural components adjacent to the filled opening and any objects passing therethrough is not critical, except that it should be of a sufficient extent to inhibit cracking or separation of the elastomeric film formed upon curing due to movement caused by expansion or contraction of the structural components or any object passing through the opening.

Generally, applying the coating from 20 mm to 40 mm along the objects passing through the opening and the structural components adjacent to the opening will be satisfactory.

The coating may be applied by brush, roller, spraying or the like. The preferred method of application is by spraying because of ease of application. It is most preferred to apply the coating by spraying using an airless setup. To ensure complete coverage, multiple passes are preferred.

The thickness of coating which should be applied is such that the cured elastomeric film has a thickness of at least 0.25 mm. This thickness will be dependent upon the volume solids of the silicone composition and may be determined by dividing the desired cured film thickness by the volume percent solids. For example, in order to obtain a cured film of at least 0.25 mm using a silicone composition having 50% volume solids, a coating of at least 0.5 mm should be applied.

The silicone compositions useful in this application have a viscosity from 1000 mPa s to 120,000 mPa s measured at 24° C. and 2.5 rpm and preferably 3000 mPa s to 100,000 mPa s measured at 24° C. and 2.5 rpm.

The rheology of the silicone composition is such that it will bridge openings of 3 mm or less without the need for support materials. Those openings larger than 3 mm which require support materials only need to be filled so that the remaining opening is 3 mm or less. It is preferred that the silicone composition exhibit pseudo plastic rheology or shear thinning, which in essence means the silicone composition has a low viscosity at high shear, such as occurs upon atomization with spray applications, and a much higher viscosity at low shear. This shear thinning characteristic facilitates the application of the coating by spraying. The coating may be applied in a thin layer which quickly thickens so that the coating does not soak into the support material or the coating may be applied in a thick layer which will not sag.

The silicone compositions useful in this invention cure into films having a number of characteristics which make them suited for this use. In order to obtain the required characteristics, the cured film should have a thickness of at least 0.25 mm. Preferably, the thickness of the cured film should be from 0.5 to 2.5 mm thick and most preferably from 0.6 mm to 1 mm thick. These thicknesses are preferred because they provide the highest movement capability, as the term is described below.

The silicone composition forms a continuous film upon curing. This means the film is substantially without cracks or voids which could allow smoke to pass through. In addition, the film should retain this continuous nature after movement by the structural components adjacent to the opening and any objects passing through the opening.

The film is elastomeric and so should be capable of accommodating contraction (−) and expansions (+) movements of at least ±3 percent, preferably at least ±10 percent and more preferably at least ±25 percent in each case relative to the nominal joint width, as measured by ASTM test method E 1399-91, "Standard Test Method for Cyclic Movement and Measuring the Minimum and Maximum Joint Widths of Architectural Joint Systems." The term "nominal joint width" as used herein means the width of the joint at rest. For example if the nominal joint width is 20 cm, then expanding and contracting the joint and the film covering the joint about ±5 cm in accordance with E 1399-91, without failure, would provide a ±25 percent movement capability relative to the nominal joint width for that film.

The film should adhere to the substrates it is covering in order to prevent the passage of smoke around the film and through the opening. The film will be considered to adhere to the various substrates if it exhibits a peel strength of at least 2 lbf/in (3N/cm) when tested according to ASTM test method C 794-93 "Standard Test Method for Adhesion-in-Peel of Elastomeric Joint Sealants" using 30 days room temperature conditioning as the cure period. This adhesion may be accomplished with the use of a separate primer, although it is preferred that the silicone composition provide this adhesion. When water based silicone compounds are used, this can be easily accomplished by spraying an initial coating of the composition thinned with water. It is preferred that the film maintain its ability to adhere to the various substrates after exposure to heat and it is more preferred that the adhesion of the film to the substrates improve after exposure to heat. This characteristic has been described by A. N. Gent et al., "Spontaneous Adhesion of Silicone Rubber", *J. Appl. Polym. Sci.*, 1982, 27, 4357–4364.

The substrates covered by the film include the structural components of the building as well as any support material filling the opening and any objects passing through the opening. Examples of the types of materials used to make the structural components include concrete, masonry, gypsum, dry wall, corrugated deck or steel. Examples of the types of materials used to make the various objects which can pass through the openings include aluminum, polyvinylchloride, chlorinated polyvinylchloride, polypropylene, acrylonitrile-butadiene-styrene terpolymer, acrylonitrile-butadiene-styrene/polyvinylchloride polymer blend terpolymer, foil/scrim all surface jacket and crosslinked polyethylene. A description of the various types of support materials has been provided earlier.

If the film is to be used for covering openings which require fire rating, it is also preferable that the film have a surface flame spread of less than 25 and a smoke density value of less than 50, in each case relative to dry red oak which equals 100, when tested in accordance with ASTM test method E 84-95 "Standard Test for Surface Burning Characteristics of Building Materials."

If a fire rating is desired or required other preferred tests the film should meet include a standard temperature-time fire test, a hose stream test and an air leakage test. The specific test method and performance standards to meet depends on the particular opening the film is sealing. If the opening has objects passing therethrough, it is preferred that the film be tested in accordance with Underwriters Laboratories (UL) 1479 dated Jun. 29, 1994, "Standard for Fire Tests of Through-Penetration Firestops." If the opening does not have objects passing therethrough, it is preferred that the film be tested in accordance with Underwriters Laboratories (UL) 2079 dated Nov. 29, 1994, "Standard for Fire Resistance of Building Joint Systems."

These test methods test the film in actual joint configurations. Ratings are established on the basis of the period of resistance to the fire exposure prior to the first development of through openings, flaming on the unexposed surface of the film and limiting thermal transmission criterion, performance under application of a hose stream after the fire test and air leakage after the fire test.

It is preferred that the film exhibit acceptable performance under a standard temperature-time fire test performed on the film while the film is held in the +25 percent extended state. It is more preferred that the film also exhibit acceptable performance under the hose stream test while the film is held in the +25 percent extended state. Further, it is most preferred that the film exhibit acceptable performance under the standard temperature-time fire test, the hose stream test and the air leakage test while the film is held in the +25 percent extended state, in each case when tested in accordance with UL1479 or UL 2079 as applicable.

Silicone compositions which form films upon curing having these characteristics include water-based silicone emulsions which cure upon the removal or evaporation of water and room temperature vulcanizing (RTV) silicone compositions which cure upon exposure to atmospheric moisture.

The water-based silicone emulsions useful herein are well known and may be prepared by known methods. For example, they can be prepared by the process of emulsion polymerization, a process well known to those skilled in the art and taught in U.S. Pat. Nos. 2,891,920, 3,294,725, 3,355,406, 3,360,491 and 3,697,469 each of which is incorporated herein by reference to show the method of preparation and types of compositions suitable for use in this invention. Another method for preparing the aqueous silicone emulsions is by emulsifying preformed diorganosiloxane polymers. This direct emulsification method is also well known to those skilled in the art and taught for example in U.S. Pat. No. 4,177,177, and pending patent applications, Berg, et al. Ser. No. 430047 filed Apr. 27, 1995 "Elastomers from Silicone Emulsions having Self Catalytic Crosslinkers," Berg, et al., Ser. No. 430776 filed Apr. 27, 1995, "Shelf-Stable Crosslinked Emulsion with Optimum Consistency and Handling without the Use of Thickeners", Joffre, et al. Ser. No. 430772, filed Apr. 27, 1995, "Improved Physical Properties from Silicone Latices through Appropriate Surfactant Selection" and Schroeder, et al Ser. No. 08/741,498 filed concurrently hereto, pending, "Sprayable Silicone Emulsions Which Form Elastomers Having Smoke and Fire Resistant Properties", each of which is hereby incorporated by reference to show the method of preparation and types of compositions suitable for use in this invention.

With emulsion polymerization, cyclic or linear siloxane oligomers are dispersed in water with a surfactant to form a premixture. Typically, amphoteric, anionic or cationic surfactants are used or mixtures of amphoteric, cationic or anionic surfactants with nonionic surfactants will also work. The premixture is then mixed at high shear until an emulsion comprising an aqueous phase and a dispersed phase comprising droplets of siloxane oligomers, having particle sizes of between 100–5000 nm, is formed. An acid or base may be added to the premixture either prior to emulsification or after emulsification is complete which catalyzes the emulsion polymerization. Alternatively, the surfactant may be converted to its acidic or basic form using an ion exchange procedure as described in U.S. Pat. No. 3,697,469 which is incorporated by reference. Although the polymerization will proceed satisfactorily at room temperature, it can be run at elevated temperatures as well, a preferred range being 25° C. to 80° C. The time of polymerization will generally take from 1 to 24 hours depending on the temperature and the desired molecular weight of the polymer. After the diorganosiloxane polymer has reached the desired molecular weight, polymerization is terminated by neutralizing the emulsion.

If required to crosslink the emulsion polymer, a crosslinker or a crosslinking catalyst or both can be added prior to emulsification or during polymerization. Oftentimes, however, the crosslinker and crosslinking catalyst will be added to the emulsion after polymerization is complete. The crosslinker, in this situation, must be capable of migrating from the water into the dispersed phase and still maintain its reactivity.

Other ingredients, such as softening agents, adhesion promoters, fillers, pigments, stabilizers, in-situ reinforcement resins, defoamers etc. may also be added at any time.

With direct emulsification, a mixture containing siloxane polymers, surfactant and water is formed at a temperature on the order of 10° C. to 70° C. and then emulsified by mixing with sufficient shear for a sufficient period of time. Typically, amphoteric, anionic, cationic or non-ionic surfactants are used singly or as mixtures. The siloxane polymers useful in this process are characterized as having a viscosity of greater than 5000 mpa.s but less than 500,000 mPa.s, however, higher molecular weight polymers can be used if the viscosity is adjusted using solvent, polymer blending etc.

If required for crosslinking the siloxane polymer, a crosslinker or crosslinking catalyst or both may be added to the mixture prior to or after the emulsification. If the crosslinker is not added to the mixture before emulsification, the crosslinker must be capable of migrating from the aqueous phase into the dispersed phase and still maintain its reactivity.

Additional amounts of water may also be added at any stage of the process if a lower polymer solids content is desired. Other ingredients, such as softening agents, adhesion promoters, fillers, pigments, stabilizers, in-situ reinforcement resins, defoamers etc. may also be added at any stage of the process.

The RTV silicone compositions useful herein are also well known and may be prepared by known methods. Typically, these compositions are prepared by mixing a diorganosiloxane polymer, a moisture-sensitive crosslinker and a filler. A catalyst is also typically added in order for curing to occur in a satisfactory time frame. Optional ingredients which may also be added, include pigments, oxidation inhibitors, adhesion promoters and dielectric materials such as carbon black and graphite.

In order to achieve the desired viscosity, the silicone RTV compositions may be formulated with low viscosity polymers. Alternatively, organic solvents or low molecular weight cyclic or linear siloxanes may be added to adjust the viscosity of the composition.

These compositions can be one part compositions in which case moisture must be excluded from the compounding and packaging processes, or a two part system where the polymer, filler and optional ingredients are in one package and the crosslinker and catalyst are in a separate package. These two packages are then mixed prior to application.

Methods of preparing suitable RTV silicone compositions are described more fully in U.S. Pat. Nos. 2,843,555; 3,161,614; 3,175,993; 3,184,427; 3,189,576; 3,334,067; 3,378,520; 3,742,004; 3,923,736; 4,657,967; 4,822,830; 4,871,827; 4,888,404; 4,973,623 each of which is hereby incorporated by reference to show the method of preparation and types of compositions suitable for use in this invention. Other patents showing the method of preparation and types of compositions suitable for use in this invention include GB 905,364; DE 2,737,303; BE 853,300; DE 2,653,498; EP 74,001; DE 4,033,096; DE 3,736,993; EP 73,994 and DE 3,032,625 each of which is also hereby incorporated by reference.

It is preferred that water-based silicone emulsions are used because of easy cleanup and in particularly from a worker safety viewpoint, as well as compliance with volatile organic compound (VOC) regulations. More preferred water-based silicone emulsions are described in the examples.

EXAMPLES

The following examples are presented for illustrative purposes and should not be construed as limiting the present invention which is delineated in the claims.

Shore A Durometer results were obtained by the method described in ASTM C661 "Indentation Hardness of Elastomeric-Type Sealants by Means of a Durometer". Tensile, modulus and elongation results were obtained by the method described in ASTM D412 "Vulcanized Rubber and Thermoplastic Rubbers and Thermoplastic Elastomers—Tension" using dumbbell specimens with an L dimension equal to 1.27 mm.

Example 1

Into a 10 liter Turello pot was charged 5000 g of a 15% trimethylsiloxy, 85% silanol endcapped polydimethylsiloxane polymer having a viscosity of 12,000 mPa s, 100 g ($Me_3SiO(Me_2SiO)_3(Me(ON(ethyl)_2)SiO)_5SiMe_3$) where Me is methyl (AOPS), 100 g methyltrimethoxysilane (MTM) and 50 g $(MeO)_2MeSiO(Me_2SiO)_nSi(OMe)_2CH_2CH_2CH_2NHCH_2CH_2NH_2$, where n=6–12 and Me is methyl (AAPS) premixed with 3.8 g glacial acetic acid. The pot was stirred for 2 min at 200 RPM to yield a uniform mixture. To this mixture was added 150 g of Tergitol® TMN-10 (ethoxylated trimethylnonanol, HLB=16.1) surfactant and 150 g of water. This mixture was stirred for 3 min at 1600 RPM. A clear, non-flowing gel was formed. This gel was further diluted by slowly adding 1000 g of water to the agitated pot over a 3 min period. This material was deaired under vacuum to yield approximately 6.5 liter of a milky white 80% solids crosslinked silicone emulsion.

Example 2

Into a 10 liter Turello pot was charged 5000 g of a 15% trimethylsiloxy, 85% silanol endcapped polydimethylsiloxane polymer having a viscosity of 12,000 mPa s, 100 g AOPS, 100 g MTM, 50 g AAPS and 3.8 g glacial acetic acid. The pot was stirred for 2 min at 200 RPM to yield a uniform mixture. To this mixture was added 150 g of a silicone glycol hydrosilation product of heptamethyltrisiloxane and ethoxylated allyl alcohol and 150 g of water. This mixture was stirred 3 min at 1600 RPM to create a clear non-flowing gel. This gel was reduced to a 80.8% solids crosslinked silicone emulsion through the addition of 1000 g of water added slowly over a period of 3 min while maintaining agitation.

Example 3

Into a 300 liter Turello pot was added 199 kg of 50,000 mPa s, silanol endblocked polydimethylsiloxane polymer and 4.5 kg of AOPS. This mixture was mixed for 1 min and a mixture of 6.3 kg of Tergitol®TMN-10 surfactant diluted with 5 kg of water was added over a 2 min period under agitation. This resulted in a clear non-flowing gel. This gel was reduced to 79.4 percent solids through the addition of 41 kg of water to yield approximately 246 liter of milky white crosslinked silicone emulsion.

Example 4

To a 300 liter Turello pot was added 160 kg 50,000 mPa s, silanol endblocked polydimethylsiloxane polymer, 3.1 kg AOPS, 2.4 kg MTM, and 1.1 kg of AAPS premixed with 0.09 kg glacial acetic acid. This mixture was stirred for 1 min and 4.5 kg Tergitol TMN-10 diluted with 3.6 kg water was slowly added while maintaining agitation. This resulted in a clear non-flowing gel which was further diluted with 21.8 kg water to yield a milky white emulsion. To this crosslinked PDMS emulsion was added 3.2 kg 100 mPa s $Me_3Si(OSiMe_2)_nOSiMe_3$ n=approximately 40 to yield approximately 204 liter of 84% solids crosslinked silicone emulsion.

Example 5

To a 10 liter Turello pot was charged 5000 g 50,000 mPa s, silanol endblocked polydimethylsiloxane polymer, 100 g AOPS, a premix consisting of 70 g MTM, 43 g $(Me)_2Si(OMe)_2$ (DMDM) and 43 g Texanol® ester alcohol; and 34.1 g AAPS and 1.9 g glacial acetic acid. The pot was stirred for 2 min at 200 rpm to yield a uniform mixture. To this mixture was added 166.7 g of Tergitol®TMN-10 and 133.3 g of water. This mixture was stirred for 3 min at 1600 rpm and a clear, non-flowing gel was formed. This gel was further diluted by slowly adding 600 g of water to the agitated pot over a 3 min. This material was deaired under vacuum to yield approximately 6.5 liter of a milky white 83.8% solids crosslinked silicone emulsion.

Example 6

To a 10 liter Turello pot was added 1715.2 g of crosslinked silicone emulsion prepared as in Example 2. To this was added 850 g of water and 49.8 g of Johncryl 61LV (water soluble polymeric acrylic resin). This mixture was stirred approximately 2 min until uniform and while agitation was maintained 1767.1 g of Hydral 710 (1 micron particle size aluminum trihydrate) (ATH) was dusted in. This mixture was allowed to stir 20 min at 2000 rpm to disperse the ATH. The composition was diluted to 70% total solids by the addition of 153.2 g of water and deaired under vacuum to yield about 4 liter of an ATH filled coating.

This coating was cast on glass and dried overnight to form a tack free elastomer. This elastomer was baked for one week at 200° C. and found to have cohesive adhesion to glass and a weight loss of only 3.91%.

Example 7

To a 10 liter Turello pot was charged 2122.6 g of water and 152.5 g of Johncryl 61LV (water soluble polymeric acrylic resin). This mixture was stirred until uniform and 2635.4 g of Hydral 710 (ATH) was added. This mixture was stirred at 800 RPM for 10 min to disperse the ATH and 26.58 g of W7114 Black (dispersion of black iron oxide (55%) in water and surfactant) was added. Stirring was continued for 2 min and 3208.51 g of the silicone emulsion described in Example 1 was added. This mixture was stirred at 800 rpm for 3 min and 5 g of Nalco 2311(mineral oil base defoamer) was added. The sample was deaired under vacuum and filtered through a 200 micron filter bag to yield approximately 8 liter of 65% solids coating.

This coating was applied using a 0.635 cm nap roller to three 0.635 cm×61 cm×244 cm Sterling boards. The coating was applied 0.25 mm thick in two coats. The coating was allowed to dry for one week and the boards were sent to Underwriters Laboratory for testing according to ASTM test method E84-95 "Standard Test Method for Surface Burning Characteristics of Building Materials." The results of the E-84 testing were less than 50 for smoke generation and less than 25 for flame spread (Dry red oak=100).

Example 8

To a 10 liter Turello pot was charged 1948.6 g of water and 158.6 g of Johncryl 61LV. This mixture was stirred until uniform and 2696.96 grams of Hydral 710 (ATH) was added. This mixture was stirred at 800 RPM for 10 min to disperse the ATH and 66.4 g of W3041 Red (dispersion of red iron oxide (68%) in water and surfactant) was added. Stirring was continued for 2 min and 3325.2 g of the silicone emulsion described in Example 2 was added. This mixture was stirred at 800 RPM for 3 min and 5.39 g of Nalco 2311 (mineral oil base defoamer) was added. The sample was deaired under vacuum and filtered through a 200 micron filter bag to yield approximately 8 liter of 67% solids coating.

This coating was applied using a 0.635 cm nap roller to three 0.635 cm×61 cm×244 cm Sterling boards. The coating was applied 0.25 mm thick in two coats. The coating was allowed to dry for one week and the boards were sent to Underwriters Laboratory for testing according to ASTM test method E84-95 "Standard Test Method for Surface Burning Characteristics of Building Materials." The results of the E-84 testing were less than 50 for smoke generation and less than 25 for flame spread (Dry red oak=100).

Example 9

Three coatings were prepared having the formulations described in Table 1. The samples were prepared by charging the described amounts of water, Tergitol TMN-6 (ethoxylated trimethylnonanol surfactant HLB=11.7) and Tergitol TMN-10 to a 10 liter Turello pot. Agitation (600 RPM) was begun and the desired pigments were dusted in (Hydral 710 and/or P25 $TiO_2$). The colorants were then added as well as the described emulsion and the mixture was stirred until uniform. If required, Nalco 1115 was then added as well as Nalco 2311 defoamer. The samples were deaired under vacuum to remove foam and filtered using a 200 micron filter bag.

TABLE 1

| Ingredients (g) | Coating 1 | Coating 2 | Coating 3 |
|---|---|---|---|
| Water | 2040 | 2034 | 805 |
| Tergitol TMN-6[1] | 9.3 | 8.5 | 8.5 |
| Tergitol TMN-10[2] | 9.3 | 8.5 | 8.5 |
| Hydral 710[3] | 2489.1 | 2327 | 2328 |
| Degussa P-25[4] | none | 166 | none |
| W7114 Black[5] | 4.1 | 17 | none |
| W1025 Yellow[6] | 16.5 | none | none |
| W3041 Red[7] | none | none | 8.5 |
| Nalco 1115[8] | none | none | 1109 |
| Example 4 Emulsion | 3692.3 | 3934 | none |
| Example 3 Emulsion | none | none | 4177.9 |
| Nalco 2311[9] | 8.3 | 8.5 | 8.5 |

[1]Tergitol TMN-6 — Ethoxylated Trimethylnonanol surfactant, HLB = 11.7
[2]Tergitol TMN-10 — Ethoxylated Trimethylnonanol surfactant HLB = 16.1
[3]Hydral 710 — 1 micron particle size aluminum trihydrate
[4]Degussa P-25 — Fumed titanium dioxide
[5]W7114 Black — Dispersion of Black Iron oxide (55%) in water and surfactant
[6]W1025 Yellow — Dispersion of Yellow Iron oxide (62%) in water and surfactant
[7]W3041 Red — Dispersion of Red Iron oxide (68%) in water and surfactant
[8]Nalco 1115 — 4 nm colloidal silica
[9]Nalco 2311 — mineral oil based defoamer The 3 coatings above were cast as 0.75 mm slabs and tested for durometer, tensile and elongation after 14 days dry time at room temperature. See Table 2.

TABLE 2

| | Durometer Shore A | Tensile psi (MPa) | Elongation % at Break | 200% Modulus psi (MPa) |
|---|---|---|---|---|
| Coating 1 | 25 | 119 (0.82) | 1485 | 58 (0.4) |
| Coating 2 | 24 | 113 (0.78) | 1310 | 52 (0.36) |
| Coating 3 | 32 | 168 (1.2) | 690 | 88 (0.61) |

When the coatings are applied, in a thickness necessary to obtain the required film thickness, to simulated floor joints packed with 50% compressed rock wool and allowed to dry for 30 days, the films from Coatings 1 and 2 will pass established performance standards necessary for meeting fire rating requirements.

Example 10

To a 10 liter Turello pot was charged 2189 g of water, 9.4 g of Tergitol TMN-6 and 9.4 g of Tergitol TMN-10. The scraper blade on the Turello was turned on and 2520 g of Hydral 710 (ATH) was added. After ATH addition, the disperser blades were turned on and the mixture was stirred at 800 RPM for 10 min. 4.16 g of W7114 black and 16.7 g of W1025 yellow (dispersion of yellow iron oxide (62%) in water and surfactant) were added and stirring was continued for an additional 2 min. Mixer was stopped and 3738 g of the crosslinked silicone emulsion described in Example 4 was added. This mixture was stirred with scraper blade and disperser blades at 800 rpm for 5 min and 4.41 g of Nalco 2311 defoamer was added. The formulated coating was deaired under vacuum and filtered through 200 micron filter to yield approximately 8 liter of coating.

The rheology of the above material was tested using a Brookfield HATDV-II viscometer in accordance with ASTM Method D2196-86 "Standard Test Method for Rheological Properties of Non-Newtonian Materials by Rotational (Brookfield) Viscometer" using a #4 Spindle at 24° C. (75° F.) The results are described in Table 3.

TABLE 3

Measurement of Viscosity of Coating at Various Speeds

| Speed (rpm) | Viscosity (mPa s) |
|---|---|
| 0.5 | $97.6 \times 10^3$ |
| 1.0 | $62.8 \times 10^3$ |
| 2.5 | $34.7 \times 10^3$ |
| 5.0 | $23.0 \times 10^3$ |
| 10.0 | $15.1 \times 10^3$ |
| 20.0 | $9.9 \times 10^3$ |
| 50.0 | $6.76 \times 10^3$ |

The liquid coating was cast on polyethylene 1.25 mm thick. This material dried to form a tack free elastomer 0.75 mm thick. After 30 days dry time the elastomer was tested for Shore A Hardness, tensile, 200% Modulus and elongation at break using an Instron Tester. The results are as follows:

| | |
|---|---|
| Tensile | 119 psi (0.82 MPa) |
| Shore A Durometer | 25 |
| % Elongation at Break | 1485 |
| 200% Modulus | 58 psi (0.4 MPa) |

This material was tested for freeze thaw stability in accordance with ASTM method D 2243-82 and no coagulation was noted after 10 freeze/thaw cycles.

When the coating is applied, in a thickness necessary to obtain the required film thickness, to simulated floor joints packed with 50% compressed rock wool and allowed to dry for 30 days, the film will pass established performance standards necessary for meeting fire rating requirements.

Example 11

To a 10 liter Turello pot was charged 2069 g of water, 8 g of Tergitol TMN-6 and 8 g of Tergitol TMN-10. The scraper blade on the Turello was turned on and 160 g of fumed titanium dioxide (P-25 from Degussa) and 2224 g of Hydral 710 (ATH) were added. After this addition, the disperser blades were turned on and the mixture was stirred at 800 rpm for 10 min. 8 g of W7114 black was added and stirring was continued for an additional 2 min. Mixer was stopped and 3538 g of the crosslinked silicone emulsion described in Example 4 was added. This mixture was stirred with scraper blade and disperser blades at 800 rpm for 5 min and 8 g of Nalco 2311 defoamer was added. Formulated coating was deaired under vacuum and filtered through 200 micron filter to yield approximately 8 liter of coating.

The rheology of the above material was tested using a Brookfield HATDV-II viscometer in accordance with ASTM Method D 2196-86 "Standard Test Method for Rheological Properties of Non-Newtonian Materials by Rotational (Brookfield) Viscomecer" using a #4 Spindle at 75° F. (24° C.) The results are provided in Table 4.

TABLE 4

| Speed (rpm) | Viscosity (mPa s) |
|---|---|
| 0.5 | $240 \times 10^3$ |
| 1.0 | $158 \times 10^3$ |
| 2.5 | $78.4 \times 10^3$ |
| 5.0 | $46.8 \times 10^3$ |
| 10.0 | $28.4 \times 10^3$ |
| 20.0 | $17.5 \times 10^3$ |

The liquid coating was cast on polyethylene 1.25 mm thick. This material dried to form a tack free elastomer 0.75 mm thick. After 30 days dry time the elastomer was tested for Shore A Hardness, tensile, 200% Modulus and elongation at break using an Instron Tester. The results are as follows:

| | |
|---|---|
| Tensile | 113 psi (0.78 MPa) |
| Shore A Durometer | 24 |
| % Elongation at Break | 1310 |
| 200% Modulus | 52 psi (0.36 MPa) |

This material was tested for freeze thaw stability in accordance with ASTM method D 2243-82 "Standard Test Method for Freeze Thaw Resistance of Latex and Emulsion Paints" and no coagulation was noted after 10 freeze/thaw cycles.

When the coating is applied, in a thickness necessary to obtain the required film thickness, to simulated floor joints packed with 50% compressed rock wool and allowed to dry for 30 days, the seals will pass established performance standards necessary for meeting fire rating requirements.

Example 12

To a 300 liter Turello pot was charged 63.4 kg water, 0.24 kg Tergitol TMN-6 and 0.24 kg Tergitol TMN-10. The scraper blade of the Turello was started and with the scraper only the following materials were poured in over a 10 min period: 4.9 kg Degussa P 25 $TiO_2$, 0.23 kg W7114 black pigment and 68.1 kg Hydral 710 (ATH). The agitators were turned on and the material was stirred for 10 min at 800 rpm. The mixer was shut down and the pot was removed and 108.3 kg of the emulsion described in Example 4 was added. The mixer was restarted and the mixture was blended until uniform (approximately 10 min). 0.23 kg Nalco 2311 defoamer was added and the material was deaired under vacuum and drummed off.

Solids of the coating were determined by baking a 1 g sample in an aluminum dish for 90 min at 150° C. The solids were 68.5%. This is in relatively good agreement with the theoretical value of 67.0%.

Samples of this material were tested for adhesion-in-peel according to ASTM C 794-93 using 30 days dry time at 22°±2° C., 50±5% relative humidity. These samples were then also tested after heating at 100° C. for 24 hr. The results are given in Table 5.

TABLE 5

| Substrate | Peel Strength 30 days 22 +/− 2° C. lbf/in (N/cm) | Peel Strength 30 days + 24 hr 100° C. lbf/in (N/cm) |
|---|---|---|
| Concrete | 2 (3.5) | 3 (5.25) |
| Grout | 4 (7) | 5 (8.75) |
| Fiber Board | 5 (8.75) | 15 (26.25) |
| Galvanized Steel | 4.5 (7.875) | 7.5 (13.125) |
| Glass | 3.5 (6.125) | 4.5 (7.875) |
| Pine | 3 (5.25) | 6 (10.5) |

Example 13

8 emulsions were prepared having the formulations described in Table 6 below. The general procedure for each sample was as follows: Charge to Hauschild cup desired amount of 50,000 mPa s, silanol endblocked polydimethylsiloxane polymer. Then add AOPS, AAPS and glacial acetic acid in desired amounts and spin 12 sec. Next, add MTM, DMDM and Texanol and stir additional 12 sec. Add Tergitol TMN-10 and first water and spin 12 sec to generate a clear gel phase. Then add dilution water spinning another 12 sec to form emulsions each having a total solid content of 80%.

TABLE 6

| | Emulsions | | | | | | | |
|---|---|---|---|---|---|---|---|---|
| Ingredients (g) | 13-1 | 13-2 | 13-3 | 13-4 | 13-5 | 13-6 | 13-7 | 13-8 |
| —OH endblocked PDMS | 69.89 | 69.89 | 69.89 | 69.89 | 69.89 | 69.89 | 69.89 | 69.89 |
| AAPS | 1.36 | 1.36 | 1.36 | 1.36 | 1.36 | 1.36 | 1.36 | 1.36 |
| AOPS | 0.45 | 0.45 | 0.45 | 0.45 | 0.45 | 0.45 | 0.45 | 0.45 |
| Acetic Acid | 0.03 | 0.03 | 0.03 | 0.03 | 0.03 | 0.03 | 0.03 | 0.03 |
| MTM | 1 | 0.98 | 1.3 | 1 | 0.9 | 1 | 1.1 | 1 |
| DMDM | 0.2 | 0.43 | 0.2 | 0.2 | 0.6 | 0.5 | 0.2 | 0.5 |
| Texanol | 0.85 | 0.27 | 0.1 | 0.85 | 0.6 | 0.6 | 0.8 | 0.1 |
| Tergitol TMN-10 | 2.14 | 2.14 | 2.14 | 2.14 | 2.14 | 2.14 | 2.14 | 2.14 |
| Water | 3.09 | 3.09 | 3.09 | 3.09 | 3.09 | 3.09 | 3.09 | 3.09 |
| dilution water | 6 | 6 | 6 | 6 | 6 | 6 | 6 | 6 |

Example 14

The eight emulsions from Example 13 were formulated into coatings using the following procedure: Charge the following materials to a Hauschild cup: 20.6 g water, 0.15 g Tergitol TMN-6, 0.15 g Tergitol TMN-10, 1.59 g Degussa P-25, 22.11 g Hydral 710 and 0.07 g W7114 Black and spin 12 sec to create a uniform dispersion of pigment in surfactant and water. To each of these dispersions was added 35.28 g of one of the emulsions from example 13, i.e. coating 13-1C used emulsion 13-1. This resulted in 8 formulated coatings each having a total solids content of 68.5% that were cast as 25 mm slabs on polyethylene. Films were allowed to dry for 14 days at 25°±5° C. and 50±2% relative humidity and then physical properties were tested. The results are provided in Table 7.

TABLE 7

| Coatings | Shore A Durometer | Tensile (MPa) | Elongation % | Modulus 200% (MPa) |
|---|---|---|---|---|
| 13-1C | 10 | 0.47 | 1295 | 0.22 |
| 13-2C | 9 | 0.37 | 1390 | 0.18 |
| 13-3C | 11 | 0.38 | 864 | 0.21 |
| 13-4C | 8 | 0.49 | 1220 | 0.23 |
| 13-5C | 9 | 0.49 | 1348 | 0.21 |
| 13-6C | 7 | 0.50 | 1370 | 0.22 |
| 13-7C | 7 | 0.54 | 1334 | 0.24 |
| 13-8C | 10 | 0.51 | 1337 | 0.22 |

Example 15

To a two gallon stainless steel pot was charged 2100 g of $HOSi(Me)_2[OSi(Me)_2]_nOSi(Me)_2OH$ where n=40 and Me is methyl, 90 g sodium laurel sulfate, 775 g deionized water and 21 g dodecybenzene sulfonic acid. This material was stirred for 30 min and then passed 3 times through a Microfluidizer® at 5000 psi. The resulting oil in water emulsion had an average particle size of 316.5 nm. This emulsion was allowed to stand overnight at 25°±5° C. and 50±2% relative humidity. After overnight reaction an aliquot of the emulsion was broken by adding methanol and the viscosity of the oil phase was determined to be greater than $1\times10^6$ cp. The polymerization of the remaining emulsion was terminated by the addition of 8.5 g of diethylamine giving an emulsion having 70% total solids.

Example 16

To a 10 liter Turello pot was charged 1280 g of Nalco 1060, a 60 nm colloidal silica from Nalco Chemical Company. With agitation at 300 RPM and scraper blade running the following items were slowly added 59.2 g AMP, 508.4 g Hydral 710 (ATH), 338 g W308, 2402.4 g Example 15 Emulsion, 10.9 g N-propylorthosilicate (NPOS) and 4 g dioctyltindilaurate. The above mixture was stirred for 10 min to achieve a smooth, lump free dispersion. This mixture was then thickened by adding a premix of 212 g water, 53.6 g ASE-75 (an acrylic associative thickener from Rohm and Haas Company) and 22.9 g RM-5 (urethane associative thickener from Rohm and Haas Company) forming a thickened coating having a total solids content of 56%. The coating was cast as a 2.5 mm slab on polyethylene. The film was allowed to dry for 14 days at 25°±5° C. and 50±2% relative humidity and then physical properties were tested. The results are as follows:

| | |
|---|---|
| Tensile | 1.75 MPa |
| Shore A Durometer | 16 |
| % Elongation at Break | 623 |
| 200% Modulus | 0.63 MPa |

This material was sent to Underwriters Laboratory in Illinois for smoke generation and flame spread testing in accordance with ASTM E-84-95 "Standard Test Method for Surface Burning Characteristics of Building Materials." The results of the E-84 testing were more than 50 for smoke generation and less than 25 for flame spread (Dry red oak=100). Therefore, this material did not pass the smoke generation portion of the test which required a number less then 50.

We claim:

1. A method of sealing openings in structural components of a building to reduce the amount of smoke which may pass through the openings, which method comprises:

(a) substantially filling an opening in a structural component with a support material so that a filled opening is formed;

(b) applying a coating of a water-based silicone emulsion composition having a viscosity from 1000 mPa s to 120,000 mPa s measured at 24° C. and 2.5 rpm, over the filled opening, the structural component adjacent to the filled opening and any objects passing therethrough; and (c) allowing the water-based silicone emulsion composition to cure into a continuous elastomeric film having a minimum thickness of 0.25 mm, which adheres to the support material in the filled opening, the adjacent structural components and any objects passing therethrough and having a movement capability of at least ±3%, the film sealing the filled opening and reducing the amount of smoke which may pass through the filled opening.

2. The method of claim 1, wherein the viscosity of the water-based silicone emulsion composition is 3000 mPa s to 100,000 mPa s measured at 24° C. and 2.5 rpm.

3. The method of claim 2, wherein the film has a movement capability of at least ±10%.

4. The method of claim 2, wherein the film has a movement capability of at least ±25%.

5. The method of claim 2, wherein the water-based silicone emulsion composition exhibits pseudo plastic rheology which facilitates the application of the coating by spraying.

6. The method of claim 4, wherein the water-based silicone emulsion composition exhibits pseudo plastic rheology which facilitates the application of the coating by spraying.

7. The method of claim 6, wherein the support material is a non-liquid, non-combustible material, the film has a flame spread rating of less than 25 and a smoke density rating of less than 50.

8. The method of claim 7, wherein the film meets temperature-time fire test requirements described by UL 1479 if the opening the film is sealing has objects passing therethrough, or temperature-time fire test requirements described by UL 2079 if the opening the film is sealing does not have objects passing therethrough, in either case when performed on the film while the film is held in the +25% extended state.

9. The method of claim 7, wherein the film meets hose stream test requirements described by UL 1479 if the opening the film is sealing has objects passing therethrough, or hose stream test requirements described by UL 2079 if the opening the film is sealing does not have objects passing therethrough, in either case when performed on the film while the film is held in a +25% extended state.

10. The method of claim 1, wherein the opening occurs where at least two structural components meet.

11. The method of claim 10, wherein the viscosity of the water-based silicone emulsion composition is 3000 mPa s to 100,000 mPa s measured at 24° C. and 2.5 rpm.

12. The method of claim 11, wherein the film has a movement capability of at least ±10%.

13. The method of claim 11, wherein the film has a movement capability of at least ±25%.

14. The method of claim 11, wherein the water-based silicone emulsion composition exhibits pseudo plastic rheology which facilitates the application of the coating by spraying.

15. The method of claim 13, wherein the water-based silicone emulsion composition exhibits pseudo plastic rheology which facilitates the application of the coating by spraying.

16. The method of claim 15, wherein the support material is a non-liquid, non-combustible material, the film has a flame spread rating of less than 25 and a smoke density rating of less than 50.

17. The method of claim 16, wherein the film meets temperature-time fire test requirements described by UL 2079 when performed on the film while the film is held in the +25% extended state.

18. The method of claim 16, wherein the film meets hose stream test requirements described by UL 2079 when performed on the film while the film is held in a +25% extended state.

19. A method of sealing openings in structural components of a building to reduce the amount of smoke which may pass through the openings, which method comprises:

a. applying a coating of a water-based silicone emulsion composition having a viscosity from 1000 mPa s to 120,000 mPa s measured at 24° C. and 2.5 rpm in a structural component having an opening of 3 mm or less in width to cover the opening, the structural component adjacent to the opening and any objects passing therethrough; and b. allowing the water-based silicone emulsion composition to cure into a continuous elastomeric film having a minimum thickness of 0.25 mm, which adheres to the adjacent structural component and any objects passing therethrough and having a movement capability of at least ±3%, the film sealing the opening and reducing the amount of smoke which may pass through the opening.

20. The method of claim 19, wherein the viscosity of the water-based silicone emulsion composition is 3000 mPa s to 100,000 mPa s measured at 24° C. and 2.5 rpm.

21. The method of claim 20, wherein the film has a movement capability of at least ±25%.

22. The method of claim 21, wherein the water-based silicone emulsion composition exhibits pseudo plastic rheology which facilitates the application of the coating by spraying.

23. The method of claim 22, wherein the film has a flame spread rating of less than 25 and a smoke generation rating of less than 50.

24. The method of claim 23, wherein the film meets temperature-time fire test requirements described by UL 1479 if the opening the film is sealing has objects passing therethrough, or temperature-time fire test requirements described by UL 2079 if the opening the film is sealing does not have objects passing therethrough, in either case when performed on the film while the film is held in the +25% extended state.

25. The method of claim 24, wherein the film meets hose stream test requirements described by UL 1479 if the opening the film is sealing has objects passing therethrough, or hose stream test requirements described by UL 2079 if the opening the film is sealing does not have objects passing therethrough, in either case when performed on the film while the film is held in a +25% extended state.

* * * * *